US009179228B2

(12) United States Patent
Ruppersberg et al.

(10) Patent No.: US 9,179,228 B2
(45) Date of Patent: Nov. 3, 2015

(54) SYSTEMS DEVICES, COMPONENTS AND METHODS FOR PROVIDING ACOUSTIC ISOLATION BETWEEN MICROPHONES AND TRANSDUCERS IN BONE CONDUCTION MAGNETIC HEARING AIDS

(71) Applicant: Sophono, Inc., Boulder, CO (US)

(72) Inventors: Peter Ruppersberg, Blonay (CH); Markus C. Haller, Nyon (CH); Todd C. Wyant, Louisville, CO (US); Nicholas F. Pergola, Arvada, CO (US)

(73) Assignee: SOPHONO, INC., Boulder, CO (US)

( * ) Notice: Subject to any disclaimer, the term of this patent is extended or adjusted under 35 U.S.C. 154(b) by 0 days.

(21) Appl. No.: 14/288,100

(22) Filed: May 27, 2014

(65) Prior Publication Data

US 2014/0270293 A1 Sep. 18, 2014

Related U.S. Application Data

(63) Continuation-in-part of application No. 13/550,581, filed on Jul. 16, 2012, now abandoned, and a continuation-in-part of application No. 13/650,026, filed on Oct. 11, 2012, and a continuation-in-part of (Continued)

(51) Int. Cl.
*H04R 25/00* (2006.01)
*H04R 3/00* (2006.01)

(52) U.S. Cl.
CPC ..... *H04R 25/606* (2013.01); *H04R 3/002* (2013.01); *H04R 25/456* (2013.01); *H04R 2460/13* (2013.01)

(58) Field of Classification Search
None
See application file for complete search history.

(56) References Cited

U.S. PATENT DOCUMENTS

| | | | | |
|---|---|---|---|---|
| 3,602,653 | A * | 8/1971 | Schaumberg et al. | 381/368 |
| 3,865,998 | A * | 2/1975 | Weiss et al. | 381/324 |
| 4,352,960 | A | 10/1982 | Dormer et al. | |
| 4,612,915 | A | 9/1986 | Hough | |
| 4,726,378 | A | 2/1988 | Kaplan | |
| 4,736,747 | A | 4/1988 | Drake | |
| RE32,947 | E | 6/1989 | Dormer et al. | |
| 4,918,745 | A | 4/1990 | Hutchinson | |
| 5,204,917 | A * | 4/1993 | Arndt et al. | 381/324 |

(Continued)

FOREIGN PATENT DOCUMENTS

| | | |
|---|---|---|
| WO | 2010/105601 | 9/2010 |
| WO | 2015/020753 A2 | 2/2015 |
| WO | 2015/034582 A2 | 3/2015 |

OTHER PUBLICATIONS

"A Miniature Bone Vibrator for Hearing Aids and Similar Applications," BHM-Tech Produktionsgesellschaft m.b.H, Austria, 2004, Technical Data VKH3391W.

(Continued)

*Primary Examiner* — Curtis Kuntz
*Assistant Examiner* — Qin Zhu
(74) *Attorney, Agent, or Firm* — Jeffrey J. Hohenshell

(57) ABSTRACT

Disclosed are various embodiments of systems, devices, components and methods for reducing feedback between a transducer and a microphone in a magnetic bone conduction hearing aid. Such systems, devices, components and methods include providing encapsulation compartments for the transducer and/or the microphone, and providing an acoustically-isolating housing for the microphone that is separate and apart from the main housing of the hearing aid.

21 Claims, 10 Drawing Sheets

Related U.S. Application Data application No. 13/650,057, filed on Oct. 11, 2012, now Pat. No. 9,022,917, and a continuation-in-part of application No. 13/650,080, filed on Oct. 11, 2012, and a continuation-in-part of application No. 13/649,934, filed on Oct. 11, 2012, and a continuation-in-part of application No. 13/804,420, filed on Mar. 14, 2013, now Pat. No. 9,031,274, and a continuation-in-part of application No. 13/793,218, filed on Mar. 11, 2013.

(60) Provisional application No. 61/970,336, filed on Mar. 25, 2014.

(56) References Cited

U.S. PATENT DOCUMENTS

| | | | | |
|---|---|---|---|---|
| 5,558,618 | A | 9/1996 | Maniglia | |
| 5,784,471 | A * | 7/1998 | Bebenroth | 381/322 |
| 5,906,635 | A | 5/1999 | Maniglia | |
| 6,246,911 | B1 | 6/2001 | Seligman | |
| 6,358,281 | B1 | 3/2002 | Berrang et al. | |
| 6,517,476 | B1 | 2/2003 | Bedoya et al. | |
| 6,537,200 | B2 | 3/2003 | Leysieffer et al. | |
| 6,560,345 | B1 * | 5/2003 | Hachisuka | 381/369 |
| 6,565,503 | B2 | 5/2003 | Leysieffer et al. | |
| 6,648,914 | B2 | 11/2003 | Berrang et al. | |
| 6,940,988 | B1 * | 9/2005 | Shennib et al. | 381/322 |
| 7,021,676 | B2 | 4/2006 | Westerkull | |
| 7,065,223 | B2 | 6/2006 | Westerkull | |
| 7,186,211 | B2 | 3/2007 | Schneider et al. | |
| 7,386,143 | B2 | 6/2008 | Easter et al. | |
| 7,502,484 | B2 * | 3/2009 | Ngia et al. | 381/320 |
| 7,599,508 | B1 | 10/2009 | Lynch et al. | |
| 7,856,986 | B2 | 12/2010 | Darley | |
| 8,107,661 | B1 | 1/2012 | Lynch et al. | |
| 8,170,253 | B1 | 5/2012 | Lynch et al. | |
| 8,255,058 | B2 | 8/2012 | Gibson et al. | |
| 8,259,975 | B2 * | 9/2012 | Bally et al. | 381/322 |
| 8,270,647 | B2 | 9/2012 | Crawford et al. | |
| 8,315,705 | B2 | 11/2012 | Keuninckx | |
| 8,369,959 | B2 | 2/2013 | Meskens | |
| 8,406,443 | B2 | 3/2013 | Westerkull et al. | |
| 8,452,412 | B2 | 5/2013 | Ibrahim | |
| 8,515,112 | B2 | 8/2013 | Crawford et al. | |
| 8,538,545 | B2 | 9/2013 | Meskens | |
| 8,774,930 | B2 | 7/2014 | Ball | |
| 8,787,608 | B2 | 7/2014 | Van Himbeeck et al. | |
| 8,811,643 | B2 | 8/2014 | Crawford et al. | |
| 8,831,260 | B2 * | 9/2014 | Parker | 381/326 |
| 8,891,795 | B2 | 11/2014 | Andersson | |
| 8,897,475 | B2 | 11/2014 | Ball | |
| 8,897,883 | B2 | 11/2014 | Griffith | |
| 8,923,968 | B2 | 12/2014 | Meskens | |
| 8,934,984 | B2 | 1/2015 | Meskens et al. | |
| 9,020,174 | B2 | 4/2015 | Asnes | |
| 2001/0007050 | A1 * | 7/2001 | Adelman | 600/150 |
| 2002/0025055 | A1 * | 2/2002 | Stonikas et al. | 381/322 |
| 2002/0143242 | A1 * | 10/2002 | Nemirovski | 600/300 |
| 2002/0150268 | A1 * | 10/2002 | Miller | 381/191 |
| 2005/0105749 | A1 * | 5/2005 | Niederdrank et al. | 381/313 |
| 2005/0222487 | A1 * | 10/2005 | Miller et al. | 600/25 |
| 2007/0053536 | A1 | 3/2007 | Westerkull | |
| 2007/0121974 | A1 * | 5/2007 | Nemirovski | 381/312 |
| 2007/0255437 | A1 * | 11/2007 | Vernon | 700/94 |
| 2007/0274551 | A1 | 11/2007 | Tsai et al. | |
| 2008/0167516 | A1 * | 7/2008 | Jaeger et al. | 600/25 |
| 2009/0030529 | A1 * | 1/2009 | Berrang et al. | 623/25 |
| 2009/0248155 | A1 | 10/2009 | Parker | |
| 2009/0299437 | A1 | 12/2009 | Zimmerling | |
| 2010/0054513 | A1 * | 3/2010 | Bally et al. | 381/322 |
| 2010/0092021 | A1 * | 4/2010 | Wiskerke et al. | 381/364 |
| 2010/0145135 | A1 | 6/2010 | Ball et al. | |
| 2010/0208924 | A1 * | 8/2010 | Westerkull | 381/318 |
| 2010/0208927 | A1 * | 8/2010 | Ritter et al. | 381/324 |
| 2011/0022120 | A1 | 1/2011 | Ball et al. | |
| 2011/0029041 | A1 * | 2/2011 | Wiskerke | 607/57 |
| 2011/0216927 | A1 * | 9/2011 | Ball | 381/313 |
| 2012/0029267 | A1 | 2/2012 | Ball | |
| 2012/0041515 | A1 | 2/2012 | Meskens et al. | |
| 2012/0078035 | A1 | 3/2012 | Andersson et al. | |
| 2012/0080039 | A1 | 4/2012 | Siegert | |
| 2012/0088956 | A1 * | 4/2012 | Asnes et al. | 600/25 |
| 2012/0088957 | A1 | 4/2012 | Adamson et al. | |
| 2012/0101514 | A1 * | 4/2012 | Keady et al. | 606/192 |
| 2012/0238799 | A1 | 9/2012 | Ball et al. | |
| 2012/0294466 | A1 | 11/2012 | Kristo et al. | |
| 2012/0296155 | A1 | 11/2012 | Ball | |
| 2012/0302823 | A1 | 11/2012 | Andersson et al. | |
| 2013/0018218 | A1 | 1/2013 | Haller et al. | |
| 2013/0046131 | A1 | 2/2013 | Ball et al. | |
| 2013/0109909 | A1 * | 5/2013 | van Gerwen | 600/25 |
| 2013/0150657 | A1 | 6/2013 | Leigh et al. | |
| 2013/0202139 | A1 * | 8/2013 | Lackert et al. | 381/317 |
| 2013/0207863 | A1 * | 8/2013 | Joshi | 343/789 |
| 2013/0236043 | A1 * | 9/2013 | Abolfathi et al. | 381/326 |
| 2013/0261377 | A1 | 10/2013 | Adamson et al. | |
| 2013/0266168 | A1 * | 10/2013 | Michel et al. | 381/328 |
| 2013/0281764 | A1 | 10/2013 | Bjorn et al. | |
| 2014/0003640 | A1 * | 1/2014 | Puria et al. | 381/318 |
| 2014/0064531 | A1 | 3/2014 | Andersson et al. | |
| 2014/0112509 | A1 * | 4/2014 | Lafort et al. | 381/322 |
| 2014/0121447 | A1 | 5/2014 | Kasic et al. | |
| 2014/0121449 | A1 | 5/2014 | Kasic et al. | |
| 2014/0121450 | A1 | 5/2014 | Kasic et al. | |
| 2014/0121451 | A1 | 5/2014 | Kasic et al. | |
| 2014/0121452 | A1 | 5/2014 | Kasic et al. | |
| 2014/0146989 | A1 * | 5/2014 | Goldstein | 381/380 |
| 2014/0163692 | A1 | 6/2014 | Van den Heuvel et al. | |
| 2014/0179985 | A1 * | 6/2014 | Andersson | 600/25 |
| 2014/0193011 | A1 | 7/2014 | Parker | |
| 2014/0270293 | A1 | 9/2014 | Ruppersberg et al. | |
| 2014/0270297 | A1 * | 9/2014 | Gustafsson et al. | 381/326 |
| 2014/0275729 | A1 * | 9/2014 | Hillbratt et al. | 600/25 |
| 2014/0275731 | A1 | 9/2014 | Andersson et al. | |
| 2014/0275735 | A1 | 9/2014 | Ruppersberg et al. | |
| 2014/0275736 | A1 | 9/2014 | Ruppersberg et al. | |
| 2014/0288357 | A1 * | 9/2014 | Hillbratt et al. | 600/25 |
| 2014/0336447 | A1 | 11/2014 | Bjorn et al. | |
| 2015/0016649 | A1 | 1/2015 | Van Himbeeck et al. | |
| 2015/0038775 | A1 | 2/2015 | Ruppersberg | |
| 2015/0043766 | A1 | 2/2015 | Westerkull | |
| 2015/0063616 | A1 | 3/2015 | Westerkull | |
| 2015/0141740 | A1 | 5/2015 | Miller | |
| 2015/0146902 | A1 | 5/2015 | Jinton et al. | |
| 2015/0156594 | A1 | 6/2015 | Bervoets | |

OTHER PUBLICATIONS

"Microphone 8010T", Data Sheet, RoHS, Sonion, Dec. 20, 2007.

"Inspiria Extreme Digital DSP System," Preliminary Data Sheet, Sound Design Technologies, Mar. 2009.

Physician Manual, Alpha I(S) and Alpha I(M) Bone Conduction Hearing Systems, REV A S0300-00.

* cited by examiner

AUDIANT
(PRIOR ART)

BAHA
(PRIOR ART)

ALPHA 1
(PRIOR ART)

SYSTEMS DEVICES, COMPONENTS AND METHODS FOR PROVIDING ACOUSTIC ISOLATION BETWEEN MICROPHONES AND TRANSDUCERS IN BONE CONDUCTION MAGNETIC HEARING AIDS

RELATED APPLICATIONS

This application is a continuation-in-part of, and claims priority and other benefits from each of the following U.S. patent applications: (a) U.S. patent application Ser. No. 13/550,581 entitled "Systems, Devices, Components and Methods for Bone Conduction Hearing Aids" to Pergola et al. filed Jul. 16, 2012 (hereafter "the '581 patent application"); (b) U.S. patent application Ser. No. 13/650,026 entitled "Magnetic Abutment Systems, Devices, Components and Methods for Bone Conduction Hearing Aids" to Kasic et al. filed on Oct. 11, 2012 (hereafter "the '650 patent application"); (c) U.S. patent application Ser. No. 13/650,057 entitled "Magnetic Spacer Systems, Devices, Components and Methods for Bone Conduction Hearing Aids" to Kasic et al. filed on Oct. 11, 2012 (hereafter "the '057 patent application"); (d) U.S. patent application Ser. No. 13/650,080 entitled "Abutment Attachment Systems, Mechanisms, Devices, Components and Methods for Bone Conduction Hearing Aids" to Kasic et al. filed on Oct. 11, 2012 (hereafter "the '080 patent application"), (e) U.S. patent application Ser. No. 13/649,934 entitled "Adjustable Magnetic Systems, Devices, Components and Methods for Bone Conduction Hearing Aids" to Kasic et al. filed on Oct. 11, 2012 (hereafter "the '934 patent application"); (f) U.S. patent application Ser. No. 13/804,420 entitled "Adhesive Bone Conduction Hearing Device" to Kasic et al. filed on Mar. 13, 2013 (hereafter "the '420 patent application"), and (g) U.S. patent application Ser. No. 13/793,218 entitled "Cover for Magnetic Implant in a Bone Conduction Hearing Aid System, and Corresponding Devices, Components and Methods" to Kasic et al. filed on Mar. 11, 2013 (hereafter "the '218 patent application").

This application also claims priority and other benefits from U.S. Provisional Patent Application Ser. No. 61/970,336 entitled "Systems, Devices, Components and Methods for Magnetic Bone Conduction Hearing Aids" to Ruppersberg et al. filed on Mar. 25, 2014. Each of the foregoing patent applications is hereby incorporated by reference herein, each in its respective entirety.

This application further incorporates by reference herein, each in its respective entirety, the following U.S. Patent Applications filed on even date herewith: (a) U.S. patent application Ser. No. 14/288,181 entitled "Sound Acquisition and Analysis Systems, Devices and Components for Magnetic Hearing Aids" to Ruppersberg et al. (hereafter "the '125 patent application"), and (b) U.S. patent application Ser. No. 14/288,142 entitled "Implantable Sound Transmission Device for Magnetic Hearing Aid, And Corresponding Systems, Devices and Components" to Ruppersberg et al. (hereafter "the '121 patent application").

FIELD OF THE INVENTION

Various embodiments of the invention described herein relate to the field of systems, devices, components, and methods for bone conduction and other types of hearing aid devices.

BACKGROUND

A magnetic bone conduction hearing aid is held in position on a patient's head by means of magnetic attraction that occurs between magnetic members included in the hearing aid and in a magnetic implant that has been implanted beneath the patient's skin and affixed to the patient's skull. Acoustic signals originating from an electromagnetic transducer located in the external hearing aid are transmitted through the patient's skin to bone in the vicinity of the underlying magnetic implant, and thence through the bone to the patient's cochlea. The acoustic signals delivered by the electromagnetic transducer are provided in to response to external ambient audio signals detected by one or more microphones disposed in external portions of the hearing aid. The fidelity and accuracy of sounds delivered to a patient's cochlea, and thus heard by a patient, can be undesirably compromised or affected by many different factors, including hearing aid coupling to the magnetic implant, and hearing aid design and configuration.

What is needed is a magnetic hearing aid system that somehow provides increased fidelity and accuracy of the sounds heard by a patient.

SUMMARY

In one embodiment, there is provided a bone conduction magnetic hearing aid comprising an electromagnetic ("EM") transducer disposed in at least one housing, at least one microphone disposed in, on or near the at least one housing, the microphone being configured to detect ambient sounds in the vicinity of the hearing aid, and a transducer encapsulation compartment disposed around the EM transducer and configured to attenuate or reduce the propagation of sound waves generated by the EM transducer to the at least one microphone.

In another embodiment, there is provided a bone conduction magnetic hearing aid comprising an electromagnetic ("EM") transducer disposed in a main housing and at least one microphone disposed in or on the main housing or in or on a microphone housing separate from the main housing, the microphone being configured to detect ambient sounds in the vicinity of the hearing aid, wherein the EM transducer is configured to generate sounds in response to the ambient sounds detected by the at least one microphone, and a microphone encapsulation compartment is disposed around the at least one microphone and configured to attenuate or reduce the propagation of sound waves generated by the EM transducer to the at least one microphone.

In still another embodiment, there is provided a method of reducing feedback between a transducer and a microphone in a bone conduction magnetic hearing aid comprising providing a transducer encapsulation compartment around the transducer that is configured to attenuate or reduce the propagation of sound waves generated by the transducer to the microphone.

In yet another embodiment, there is provided a method of reducing feedback between a transducer and a microphone in a bone conduction magnetic hearing aid comprising providing a microphone encapsulation compartment or sound attenuating or absorbing material around the microphone that is configured to attenuate or reduce the propagation of sound waves generated by the transducer to the microphone.

Further embodiments are disclosed herein or will become apparent to those skilled in the art after having read and understood the specification and drawings hereof.

BRIEF DESCRIPTION OF THE DRAWINGS

Different aspects of the various embodiments will become apparent from the following specification, drawings and claims in which:

FIG. 2(*b*) shows one embodiment of a prior art wiring diagram for a SOPHONO ALPHA 1 hearing aid manufactured using an SA3286 DSP;

FIG. 3(*b*) shows one embodiment of a prior art SOPHONO® ALPHA 1® hearing aid 10;

FIG. 3(*c*) shows another embodiment of a prior art SOPHONO® ALPHA® hearing aid 10.

The drawings are not necessarily to scale. Like numbers refer to like parts or steps throughout the drawings.

DETAILED DESCRIPTIONS OF SOME EMBODIMENTS

Described herein are various embodiments of systems, devices, components and methods for bone conduction and/or bone-anchored hearing aids.

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHA systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or iPod by means of attaching a miniaturized FM receiver or Bluetooth connection thereto.

BAHD devices manufactured by COCHLEAR™ of Sydney, Australia, and OTICON™ of Smoerum, Denmark. SOPHONO™ of Boulder, Colo. manufactures an Alpha 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by Sophono, Inc. of Boulder, Colo., the entirety of which is hereby incorporated by reference herein.

Figure 1C:
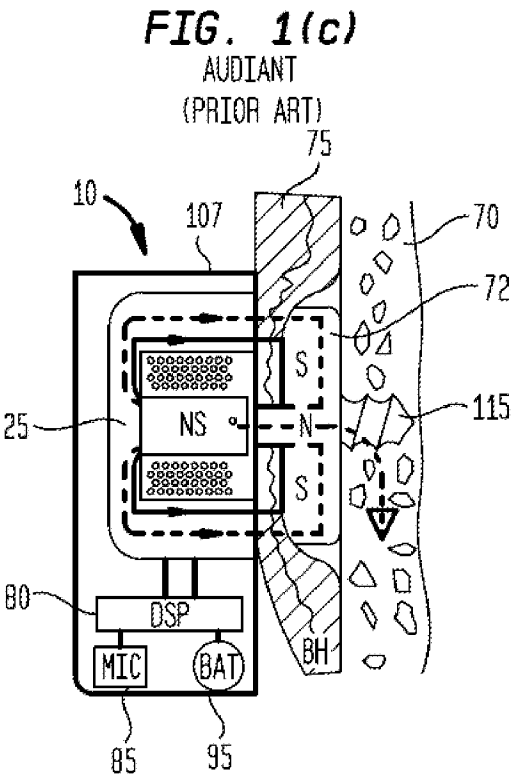
FIGS. 1(*a*), 1(*b*) and 1(*c*) show side cross-sectional schematic views of selected embodiments of prior art SOPHONO® ALPHA 1™, BAHA® and AUDIANT® bone conduction hearing aids, respectively.
Figure 1B:
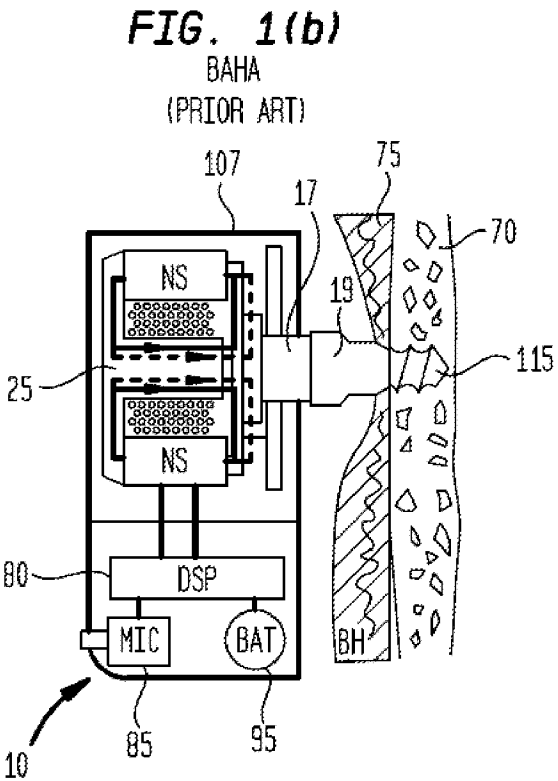
Figure 1A:
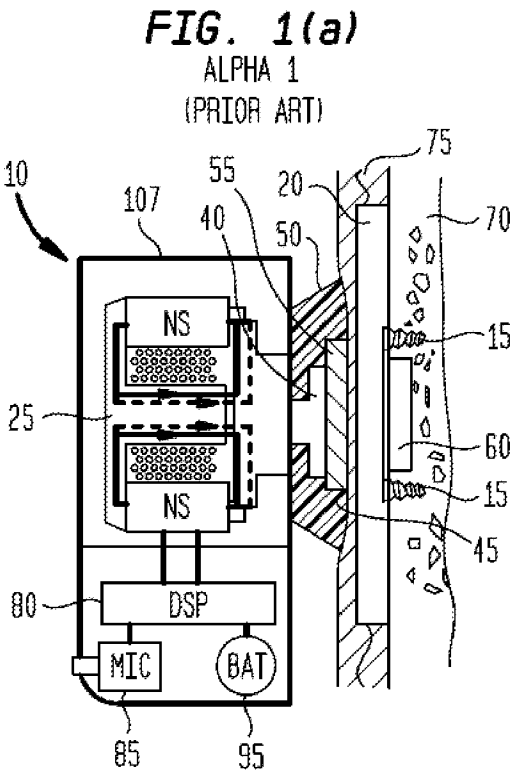

FIGS. 1(*a*), 1(*b*) and 1(*c*) show side cross-sectional schematic views of selected embodiments of prior art SOPHONO ALPHA 1, BAHA and AUDIANT bone conduction hearing aids, respectively. Note that FIGS. 1(*a*), 1(*b*) and 1(*c*) are not necessarily to scale.

In FIG. 1(*a*), magnetic hearing aid device 10 comprises housing 107, electromagnetic/bone conduction ("EM") transducer 25 with corresponding magnets and coils, digital signal processor ("DSP") 80, battery 95, magnetic spacer 50, magnetic implant or magnetic implant bone plate 20. As shown in FIGS. 1(*a*) and 2(*a*), and according to one embodiment, magnetic implant 20 comprises a frame 21 (see FIG. 3(*a*)) formed of a biocompatible metal such as medical grade titanium that is configured to have disposed therein or have attached thereto implantable magnets or magnetic members 60. Bone screws 15 secure or affix magnetic implant 20 to skull 70, and are disposed through screw holes 23 positioned at the outward ends of arms 22 of magnetic implant frame 21 (see FIG. 3(*a*)). Magnetic members 60*a* and 60*b* are configured to couple magnetically to one or more corresponding external magnetic members or magnets 55 mounted onto or into, or otherwise forming a portion of, magnetic spacer 50, which in turn is operably coupled to EM transducer 25 and metal disc 40. DSP 80 is configured to drive EM transducer 25, metal disk 40 and magnetic spacer 50 in accordance with external audio signals picked up by microphone 85. DSP 80 and EM transducer 25 are powered by battery 95, which according to one embodiment may be a zinc-air battery, or may be any other suitable type of primary or secondary (i.e., rechargeable) electrochemical cell such as an alkaline or lithium battery.

As further shown in FIG. 1(*a*), magnetic implant 20 is attached to patient's skull 70, and is separated from magnetic spacer 50 by patient's skin 75. Hearing aid device 10 of FIG. 1(*a*) is thereby operably coupled magnetically and mechanically to plate 20 implanted in patient's skull 70, which permits the transmission of audio signals originating in DSP 80 and EM transducer 25 to the patient's inner ear via skull 70.

FIG. 1(*b*) shows another embodiment of hearing aid 10, which is a BAHA® device comprising housing 107, EM transducer 25 with corresponding magnets and coils, DSP 80, battery 95, external post 17, internal bone anchor 115, and abutment member 19. In one embodiment, and as shown in FIG. 1(*b*), internal bone anchor 115 includes a bone screw formed of a biocompatible metal such as titanium that is configured to have disposed thereon or have attached thereto abutment member 19, which in turn may be configured to mate mechanically or magnetically with external post 17, which in turn is operably coupled to EM transducer 25. DSP 80 is configured to drive EM transducer 25 and external post 17 in accordance with external audio signals picked up by microphone 85. DSP 80 and EM transducer 25 are powered by battery 95, which according to one embodiment is a zinc-air battery (or any other suitable battery or electrochemical cell as described above). As shown in FIG. 1(*b*), implantable bone anchor 115 is attached to patient's skull 70, and is also attached to external post 17 through abutment member 19, either mechanically or by magnetic means. Hearing aid device 10 of FIG. 1(*b*) is thus coupled magnetically and/or mechanically to bone anchor 115 implanted in patient's skull 70, thereby permitting the transmission of audio signals originating in DSP 80 and EM transducer 25 to the patient's inner ear via skull 70.

FIG. 1(*c*) shows another embodiment of hearing aid 10, which is an AUDIANT®-type device, where an implantable magnetic member 72 is attached by means of bone anchor 115 to patient's skull 70. Internal bone anchor 115 includes a bone screw formed of a biocompatible metal such as titanium, and has disposed thereon or attached thereto implantable magnetic member 72, which couples magnetically through patient's skin 75 to EM transducer 25. Processor 80 is configured to drive EM transducer 25 in accordance with external audio signals picked up by microphone 85. Hearing aid device 10 of FIG. 1(*c*) is thus coupled magnetically to bone anchor 115 implanted in patient's skull 70, thereby permitting the transmission of audio signals originating in processor 80 and EM transducer 25 to the patient's inner ear via skull 70.

Figure 2A:
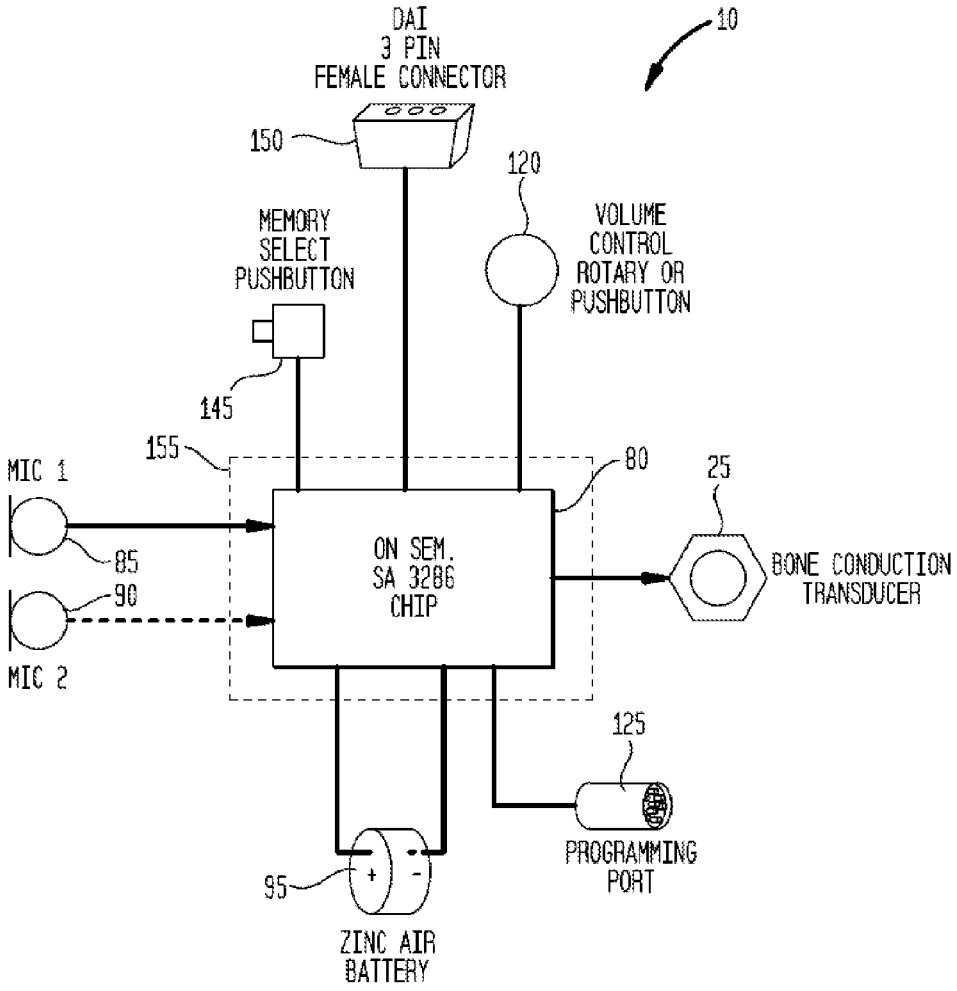
FIG. 2(a) (PRIOR ART)
FIG. 2(*a*) shows one embodiment of a prior art functional electronic and electrical block diagram of hearing aid 10 shown in FIGS. 1(*a*) and 3(*b*)
Figure 2B:
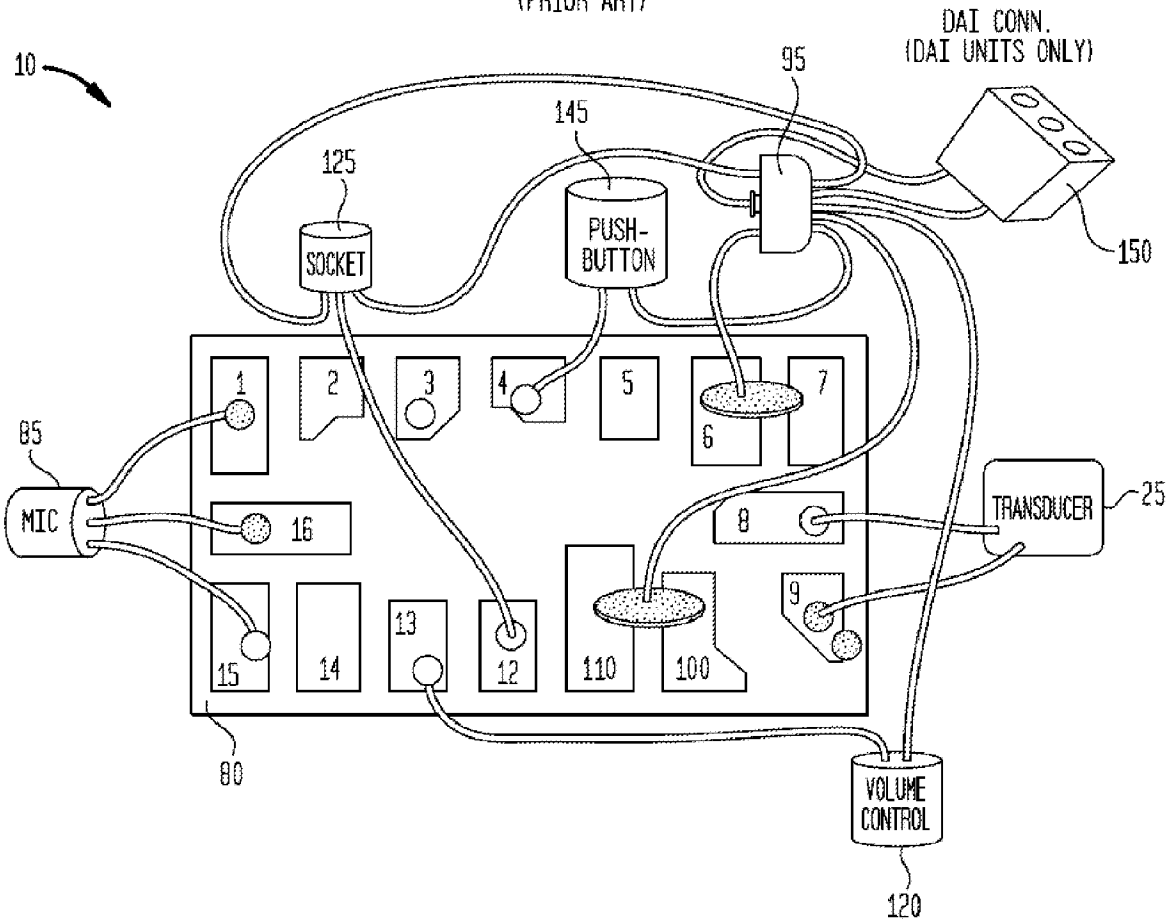
FIG. 2(b) (PRIOR ART)

FIG. 2(*a*) shows one embodiment of a prior art functional electronic and electrical block diagram of hearing aid 10 shown in FIGS. 1(*a*) and 2(*b*). In the block diagram of FIG. 2(*a*), and according to one embodiment, processor 80 is a SOUND DESIGN TECHNOLOGIES® SA3286 INSPIRA EXTREME® DIGITAL DSP, for which data sheet 48550-2 dated March 2009, filed on even date herewith in an accompanying Information Disclosure Statement ("IDS"), is hereby incorporated by reference herein in its entirety. The audio processor for the SOPHONO ALPHA 1 hearing aid is centered around DSP chip 80, which provides programmable signal processing. The signal processing may be customized by to computer software which communicates with the Alpha through programming port 125. According to one embodiment, the system is powered by a standard zinc air battery 95 (i.e. hearing aid battery), although other types of batteries may be employed. The SOPHONO ALPHA 1 hearing aid detects acoustic signals using a miniature microphone 85. A second microphone 90 may also be employed, as shown in FIG. 2(*a*). The SA 3286 chip supports directional audio processing with second microphone 90 to enable directional processing. Direct Audio Input (DAI) connector 150 allows connection of accessories which provide an audio signal in addition to or in lieu of the microphone signal. The most common usage of the DAI connector is FM systems. The FM receiver may be plugged into DAI connector 150. Such an FM transmitter can be worn, for example, by a teacher in a classroom to ensure the teacher is heard clearly by a student wearing hearing aid 10. Other DAI accessories include an adapter for a music player, a telecoil, or a Bluetooth phone accessory. According to one embodiment, processor 80 or SA 3286 has 4 available program memories, allowing a hearing health professional to customize each of 4 programs for different listening situations. The Memory Select Pushbutton 145 allows the user to choose from the activated memories. This might include special frequency adjustments for noisy situations, or a program which is Directional, or a program which uses the DAI input.

FIG. 2(*b*) shows one embodiment of a prior art wiring diagram for a SOPHONO ALPHA 1 hearing aid manufactured using the foregoing SA3286 DSP. Note that the various embodiments of hearing aid 10 are not limited to the use of a SA3286 DSP, and that any other suitable CPU, processor, controller or computing device may be used. According to one embodiment, processor 80 is mounted on a printed circuit board 155 disposed within housing 107 of hearing aid 10.

In some embodiments, the microphone incorporated into hearing aid 10 is an 8010T microphone manufactured by SONION®, for which data sheet 3800-3016007, Version 1 dated December, 2007, filed on even date herewith in the accompanying IDS, is hereby incorporated by reference herein in its entirety. In the various embodiment of hearing aids claimed herein, other suitable types of microphones, including other types of capacitive microphones, may be employed. In still further embodiments of hearing aids claimed herein, electromagnetic transducer 25 incorporated into hearing aid 10 is a VKH3391W transducer manufactured by BMH-Tech® of Austria, for which the data sheet filed on even date herewith in the accompanying IDS is hereby incorporated by reference herein in its entirety. Other types of suitable EM or other types of transducers may also be used.

Figure 3C:
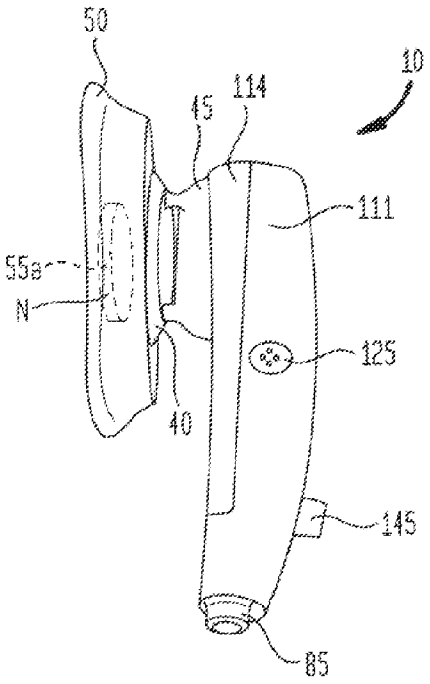
FIG. 3(c) (PRIOR ART)
FIG. 3(*a*) shows one embodiment of prior art magnetic implant 20 according to FIG. 1(*a*)
Figure 3B:
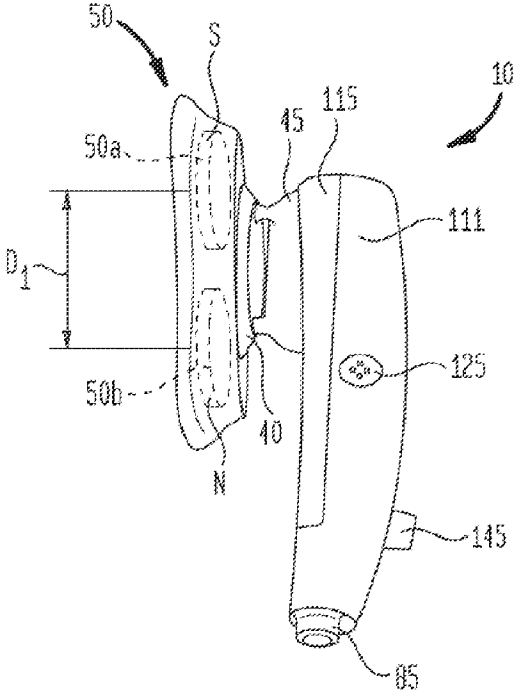
FIG. 3(b) (PRIOR ART)
Figure 3A:
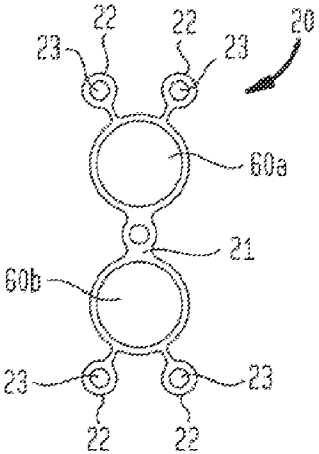
FIG. 3(a) (PRIOR ART)

FIGS. 3(*a*), 3(*b*) and 3(*c*) show implantable bone plate or magnetic implant 20 in accordance with FIG. 1(*a*), where frame 22 has disposed thereon or therein magnetic members 60*a* and 60*b*, and where magnetic spacer 50 of hearing aid 10 has magnetic members 55*a* and 55*b* spacer disposed therein. The two magnets 60*a* and 60*b* of magnetic implant 20 of FIG. 2(*a*) permit hearing aid 10 and magnetic spacer 50 to be placed in a single position on patient's skull 70, with respective opposing north and south poles of magnetic members 55*a*, 60*a*, 55*b* and 60*b* appropriately aligned with respect to one another to permit a sufficient degree of magnetic coupling to be achieved between magnetic spacer 50 and to magnetic implant 20 (see FIG. 3(*b*)). As shown in FIG. 1(*a*), magnetic implant 20 is preferably configured to be affixed to skull 70 under patient's skin 75. In one aspect, affixation of magnetic implant 20 to skull 75 is by direct means, such as by screws 15. Other means of attachment known to those skilled in the art are also contemplated, however, such as glue, epoxy, and sutures.

Referring now to FIG. 3(*b*), there is shown a SOPHONO® ALPHA 1® hearing aid 10 configured to operate in accordance with magnetic implant 20 of FIG. 3(*a*). As shown, hearing aid 10 of FIG. 3(*b*) comprises upper housing 112, lower housing 114, magnetic spacer 50, external magnets 55*a* and 55*b* disposed within spacer 50, EM transducer diaphragm 45, metal disk 40 connecting EM transducer 25 to spacer 50, programming port/socket 125, program switch 145, and microphone 85. Not shown in FIG. 3(*b*) are other aspects of the embodiment of hearing aid 10, such as volume control 120, battery compartment 130, battery door 135, battery contacts 140, direct audio input (DAI) 150, and hearing aid circuit board 155 upon which various components are mounted, such as processor 80.

Continuing to refer to FIGS. 3(*a*) and 3(*b*), frame 22 of magnetic implant 20 holds a pair of magnets 60*a* and 60*b* that correspond to magnets 55*a* and 55*b* included in spacer 50 shown in FIG. 3(*b*). The south (S) pole and north (N) poles of magnets 55*a* and 55*b*, are respectively configured in spacer 50 such that the south pole of magnet 55*a* is intended to overlie and magnetically couple to the north pole of magnet 60*a*, and such that the north pole of magnet 55*b* is intended to overlie and magnetically couple to the south pole of magnet 60*b*. This arrangement and configuration of magnets 55*a*, 55*b*, 60*a* and 60*b* is intended permit the magnetic forces required to hold hearing aid 10 onto a patient's head to to be spread out or dispersed over a relatively wide surface area of the patient's hair and/or skin 75, and thereby prevent irritation of soreness that might otherwise occur if such magnetic forces were spread out over a smaller or more narrow surface area. In the embodiment shown in FIG. 3(*a*), frame 22 and magnetic implant 20 are configured for affixation to patient's skull 70 by means of screws 15, which are placed through screw recesses or holes 23. FIG. 3(*c*) shows an embodiment of hearing aid 10 configured to operate in conjunction with a single magnet 60 disposed in magnetic implant 20 per FIG. 1(*a*).

Referring now to FIGS. 4 through 9, there are shown various embodiments and views of hearing aid 10 having improved acoustic isolation between one or more microphones 85 and transducer 25. It has been discovered that sounds generated by electromagnetic transducer 25 can be undesirably sensed or picked up by microphone 85, which can affect the fidelity or accuracy of the sounds delivered to the patient's cochlea. In particular, undesirable feedback between transducer 25 and microphones 85 has been discovered to occur in at least some of the prior art versions of hearing aid 10 described above. Such feedback can affect the fidelity and accuracy of the sounds delivered to a patient by hearing aid 10. Described below are various means and methods of solving this problem, and of better acoustically isolating one or more microphones 85 from transducer 25.

Before describing the various embodiments of hearing aid 10 that provide improved acoustic isolation between microphone(s) 85 and transducer 25, it is to be noted that processor 80 shown in FIG. 1(*b*) is a DSP or digital signal processor. After having read and understood the present specification, however, those skilled in the art will understand that hearing aid 10 incorporating the various acoustic isolation means and methods described below may be employed in conjunction with processors 80 other than, or in addition to, a DSP. Such processors include, but are not limited to, CPUs, processors, microprocessors, controllers, microcontrollers, application specific integrated circuits (ASICs) and the like. Such processors 80 are programmed and configured to process the ambient external audio signals sensed by picked up by microphone 85, and further are programmed to drive transducer 25 in accordance with the sensed ambient external audio signals. Moreover, more than one such processor 80 may be employed in hearing aid 10 to accomplish such functionality, where the processors are operably connected to one another. Electrical or electronic circuitry in addition to that shown in FIGS. 1(*a*) through 2(*b*) may also be employed in hearing aid 10, such as amplifiers, filters, and wireless or hardwired communication circuits that permit hearing aid 10 to communicate with or be programmed by external devices.

Microphones 85 or other types of transducers in addition to the SONION® microphone described above may be employed in the various embodiments of hearing aid 10, including, but not limited to, receivers, telecoils (both active and passive), noise cancelling microphones, and vibration sensors. Such transducers are referred to generically herein as "microphones." Transducers 25 other than the VKH3391W EM transducer described above may also be employed in hearing aid 10, including, but not limited to, suitable piezoelectric transducers.

Figure 4:
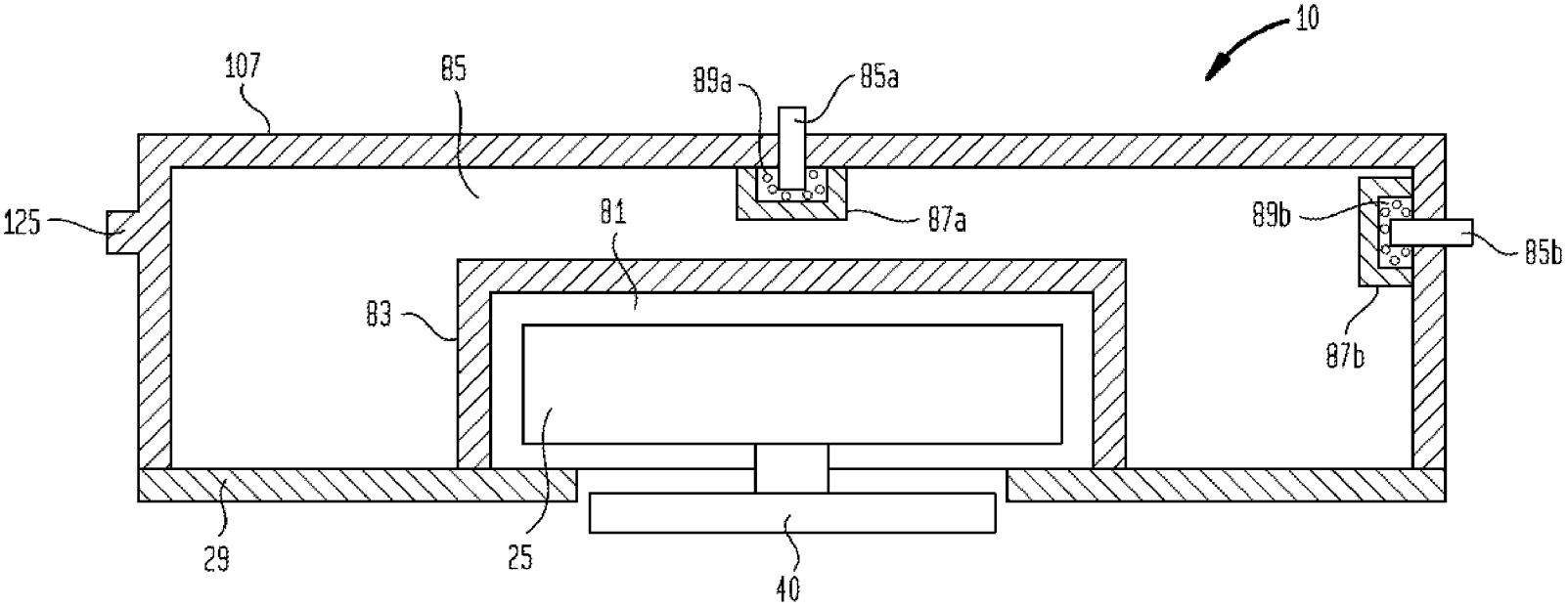
FIGS. 4 through 9 show various embodiments and views of hearing aid 10 having improved acoustic isolation between one or more microphones 85 and transducer 25.

FIG. 4 shows a cross-sectional view of one embodiment of hearing aid 10 where only some portions of hearing aid 10 are shown, e.g., those relating to providing one or more acoustic barriers or isolating means between microphones 85*a* and 85*b*, and transducer 25 in hearing aid 10. In FIG. 4, main hearing aid housing 107 includes therein or has attached thereto transducer 25 and microphones 85*a* and 85*b*. Metal disc 40 is operably connected to transducer 25, and permits hearing aid 10 to be operably connected to underlying magnetic spacer 50 (not shown in FIGS. 4 through 8) for the delivery of sound generated by transducer 25 to the patient's cochlear by bone conduction means. In the embodiment shown in FIG. 4, a transducer acoustic barrier or shield 83 (or transducer encapsulation compartment 83) is provided that surrounds transducer 25, and that is configured to block, absorb and/or attenuate sounds originating from transducer 25 that might otherwise enter space or volume 85, which is in proximity to microphones 85*a* and 85*b*. During the process of generating sound, transducer 25 vibrates and shakes inside transducer encapsulation compartment 83 as it delivers sound to disk 40, magnetic spacer 50 and the patient's cochlea.

Transducer encapsulation compartment 83 prevents, attenuates, blocks, reduces, minimizes, and/or substantially eliminates the propagation of audio signals between transducer 25 and microphones 85*a* and 85*b*. In one embodiment, transducer encapsulation compartment 83 is configured to absorb and/or partially absorb audio signals originating from transducer 25, and comprises or is formed of, by way of non-limiting example, one or more of a poro-elastic material, a porous material, a foam, a polyurethane foam, polymer microparticles, an inorganic polymeric foam, a polyurethane foam, a smart foam (e.g., a foam which operates passively at higher frequencies and that also includes an active input of a PVDF or polyvinylidene fluoride element driven by an oscillating electrical input, which is effective at lower frequencies), a cellular porous sound absorbing material, cellular melamine, a granular porous sound absorbing material, a fibrous porous sound absorbing material, a closed-cell metal foam, a metal foam, a gel, an aerogel, or any other suitable sound-absorbing or attenuating material.

Transducer encapsulation compartment 83 may also be formed of a flexural sound absorbing material, or of a resonant sound absorbing material, that is configured to damp and reflect sound waves incident thereon. Such materials are generally non-porous elastic materials configured to flex due to excitation from sound energy, and thereby dissipate the sound energy incident thereon, and/or to reflect some portion of the sound energy incident thereon.

Continuing to refer to FIG. 4, microphones 85*a* and 85*b* are shown as being mounted or attached to main housing 107. Two microphones 85*a* and 85*b* are shown as being disposed in different locations on main housing 107, one on the top of main housing 107 (microphone 85*a*) and one on the bottom of main housing 107 (microphone 85*b*). In the various embodiments described herein, only one of such microphones may be employed in hearing aid 10, or additional microphone(s) may be employed. In FIG. 4, microphones 85*a* and 85*b* are shown as being surrounded by microphone encapsulation compartments 87*a* and 87*b*, respectively, which according to various embodiments may or may not include sound attenuating or absorbing materials 89*a* and 89*b*. Alternatively, microphones 85*a* and 85*b* may be potted in or surrounded only by sound attenuating or absorbing materials 89*a* and 89*b*.

In one embodiment, microphone encapsulation compartments 87*a* and 87*b* are configured to absorb and/or partially absorb audio signals originating from transducer 25, and comprise or are formed of, by way of non-limiting example, one or more of a poro-elastic material, a porous material, a foam, a polyurethane foam, polymer microparticles, an inorganic polymeric foam, a polyurethane foam, a cellular porous sound absorbing material, cellular melamine, a granular porous sound absorbing material, a fibrous porous sound absorbing material, a closed-cell metal foam, a metal foam, a gel, an aerogel, or any other suitable sound-absorbing or attenuating material. The same or similar materials may be employed in sound attenuating or absorbing materials 89*a* and 89*b*.

Microphone encapsulation compartments 87*a* and 87*b* may also be formed of flexural sound absorbing materials, or of resonant sound absorbing materials, that are configured to damp and reflect sound waves incident thereon. Such materials are generally non-porous elastic materials configured to flex due to excitation from sound energy, and thereby dissipate the sound energy incident thereon, and/or to reflect some portion of the sound energy incident thereon.

In some embodiments, no sound attenuating or absorbing materials, flexural sound absorbing materials, or resonant sound absorbing materials 89*a* and 89*b* are disposed between microphone encapsulation compartments 87*a* and 87*b* and respective microphones 85*a* and 85*b* associated therewith.

In other embodiments, microphones 85*a* and 85*b* are directional microphones configured to selectively sense external audio signals in preference to undesired audio signals originating from transducer 25.

In further embodiments, one or more noise cancellation microphones (not shown in FIG. 4) are provided inside main housing 107, and are positioned and configured to sense undesired audio signals originating from transducer 25. Output signals generated by the one or more noise cancellation microphones are routed to processor 80, where adaptive filtering or other suitable digital signal processing techniques known to those skilled in the art (e.g., adaptive feedback reduction algorithms using adaptive gain reduction, notch filtering, and phase cancellation strategies) are employed to remove or cancel major portions of undesired transducer/microphone feedback noise from the sound delivered that is to the patient's cochlea by transducer 25 and hearing aid 10.

Continuing to refer to FIG. 4, in some embodiments only a selected one or more of transducer encapsulation compartment 83, microphone encapsulation compartments 87*a* and 87*b*, and sound attenuating or absorbing materials, flexural sound absorbing materials, or resonant sound absorbing materials 89*a* and 89*b* are employed in hearing aid 10.

Figure 5:
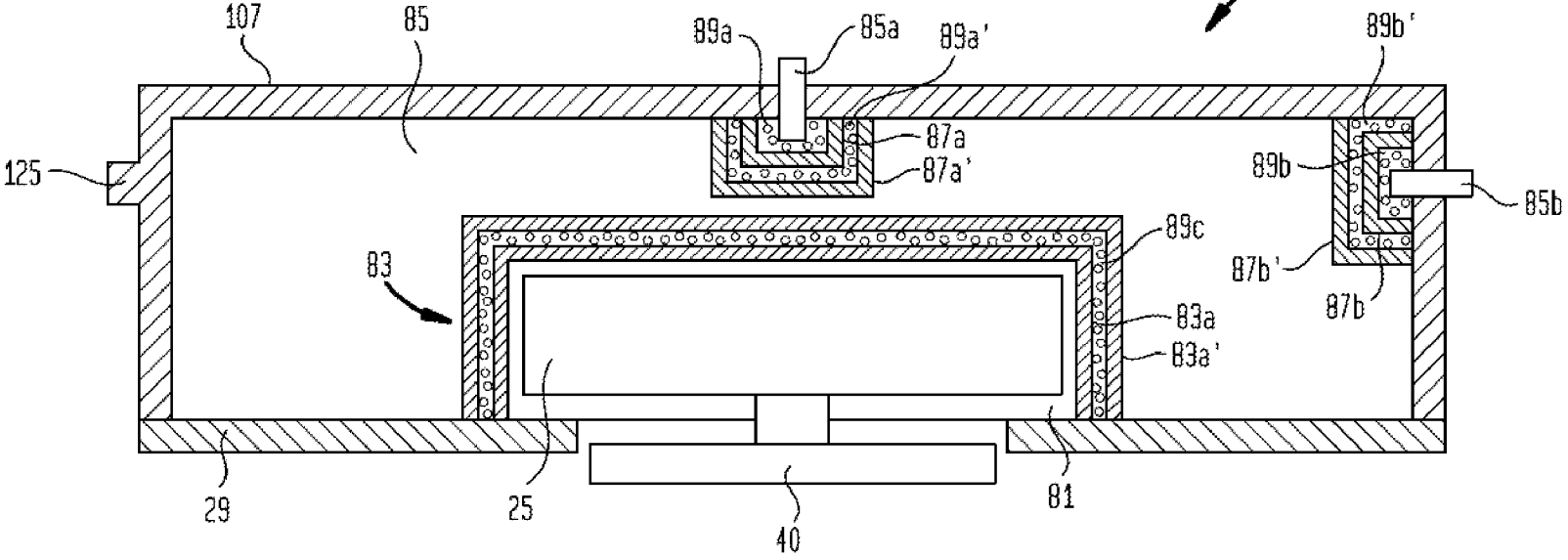

Referring now to FIG. 5, there is shown a cross-sectional view of another embodiment of hearing aid 10 where only some portions of hearing aid 10 are shown, e.g., those relating to providing one or more acoustic barriers or isolating means between microphones 85*a* and 85*b* and transducer 25 in hearing aid 10. In the embodiment shown in FIG. 5, transducer encapsulation compartment 83 comprises multiple layers or components, namely inner transducer encapsulation compartment 83*a*, sound attenuating or absorbing material, flexural sound absorbing material, or resonant sound absorbing material 89*c*, and outer transducer encapsulation compartment 83*a*'. Such a configuration of nested transducer encapsulation compartments 83*a* and 83*a*' separated by sound attenuating or absorbing material 89*c* results in increased deadening or attenuation of undesired sound originating from transducer 25 that might otherwise enter volume or space 85 and adversely affect the performance of microphones 85*a* and 85*b*. In some embodiments, and by way of non-limiting example, transducer encapsulation compartment 83 of FIG. 5 is manufactured by sandwiching sound attenuating or absorbing material, flexural sound absorbing material, or resonant sound absorbing material 89*c* between overmolded layers of a suitable polymeric or other material.

Continuing to refer to FIG. 5, and in a similar manner, one or more of microphones 85*a* and 85*b* is surrounded by nested inner and outer microphone encapsulation compartments 87*a* and 87*a*', and 87*b* and 87*b*', respectively, which in turn are separated by sound attenuating or absorbing materials, flexural sound absorbing materials, or resonant sound absorbing materials 89*a*' and 89*b*', respectively. Such a configuration of nested microphone encapsulation compartments 87*a*/87*a*' and 87*b*/87*b*' separated by sound attenuating or absorbing materials 89*a*' and 89*b*' results in increased deadening or attenuation of undesired sound originating from transducer 25 impinging upon microphones 85*a* and 85*b* and thereby adversely affecting the performance of such microphones. In some embodiments, and by way of non-limiting example, microphone encapsulation compartments 87*a*/87*a*' and 87*b*/87*b*' are manufactured by sandwiching sound attenuating or absorbing material, flexural sound absorbing material, or resonant sound absorbing materials 89*a*' and 89*b*' between overmolded layers of a suitable polymeric or other material.

Continuing to refer to FIG. 5, in some embodiments only a selected one or more of transducer encapsulation compartment 83, microphone encapsulation compartment 87*a*, microphone encapsulation compartment 87*a*', microphone encapsulation compartment 87*b*, microphone encapsulation compartment 87*b*', and sound attenuating or absorbing material, flexural sound absorbing material, or resonant sound absorbing material 89*a*, 89*a*', 89*b*, and 89*b*' are employed in hearing aid 10.

Note further that in some embodiments of transducer encapsulation compartment 83 and microphone encapsulation compartments 87*a*/87*a*' and 87*b*/87*b*' shown in FIG. 5 may also be modified such that air, a sound-deadening gas, a sound-deadening liquid, a sound-deadening gel, or a vacuum is disposed between the nested inner and outer encapsulation compartments to enhance the sound-attenuating properties of such encapsulation compartments. Moreover, a vacuum or suitable gas may be disposed in volume or space 81 of transducer encapsulation compartment 83, where compartment 83 is hermetically sealed, thereby to reduce or attenuate the propagation of unwanted transducer audio signals into volume or space 85 of main housing 107.

Referring now to FIGS. 4 and 5, any one or more of transducer encapsulation compartment 83, microphone encapsulation compartments 87, 87*a*, 87*a*', 87*b* and 87*b*' may be dimensioned, configured and formed of appropriate materials such that such compartments are tuned to resonate, and therefore dissipate sound energy, at peak frequencies associated with noise generated by transducer 25.

Figure 6:
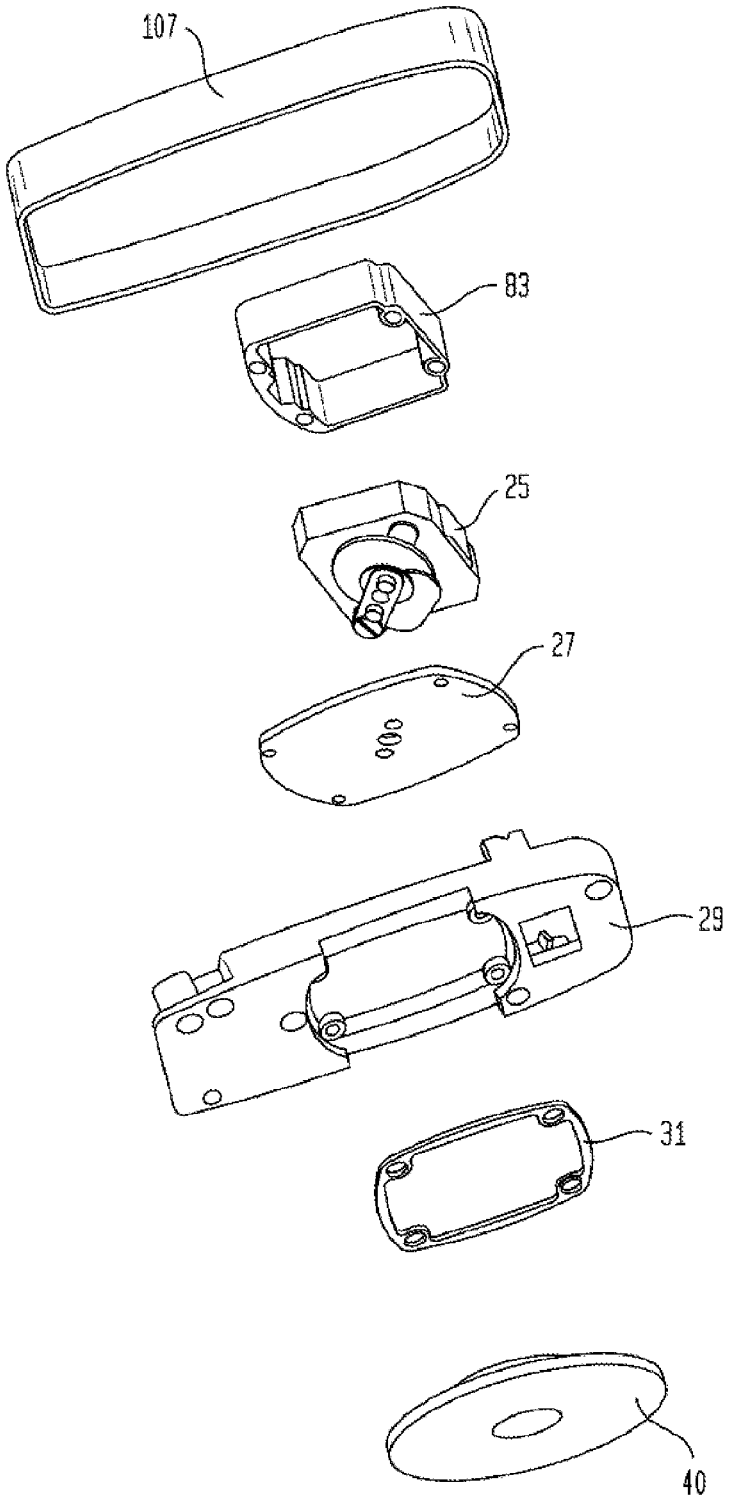

FIG. 6 shows an exploded bottom perspective view of one embodiment of portions of hearing aid 10, where such embodiment is similar to hearing aid 10 shown in FIG. 4. In FIG. 6, there are shown main housing 107, transducer encapsulation compartment 83, EM transducer 25, membrane 27, bottom housing plate 29, frame clip 31, and metal disk 40. Membrane 27 may be formed of an elastomeric material such as medical grade silicone, and is configured to provide a seal to prevent the ingress of dust, dirt, moisture, hair or skin oil, and other undesired external contaminants to the interior of housing 107.

Figure 7:
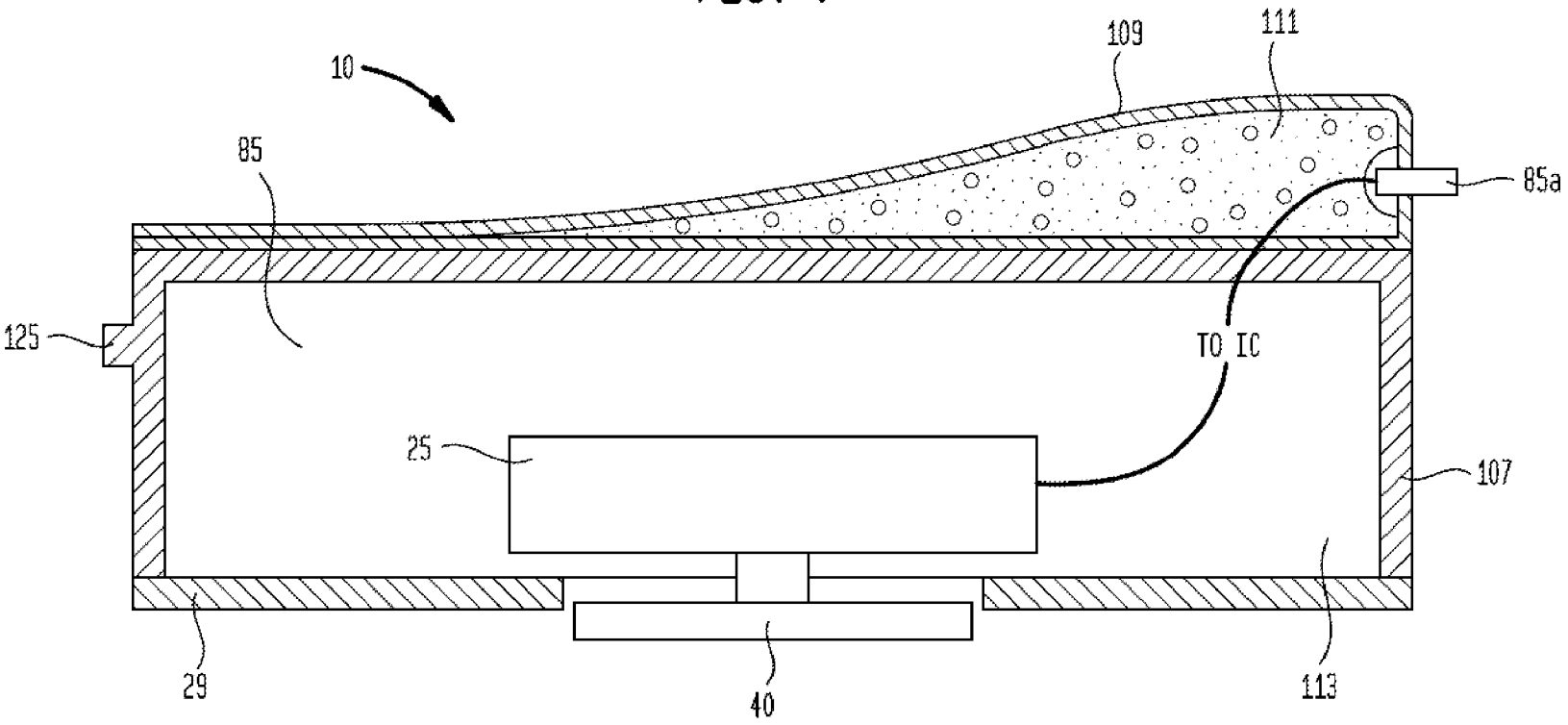
Figure 8:
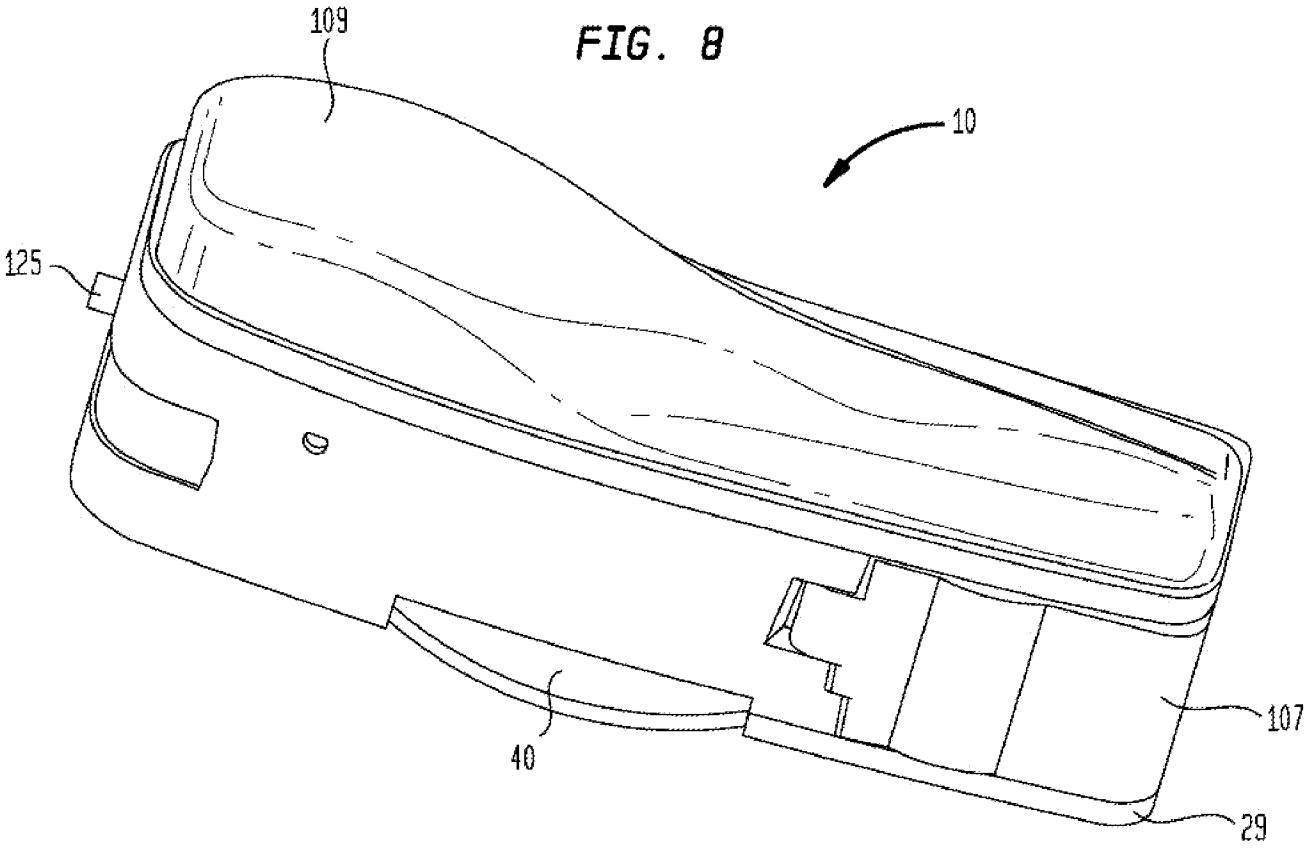
Figure 9:
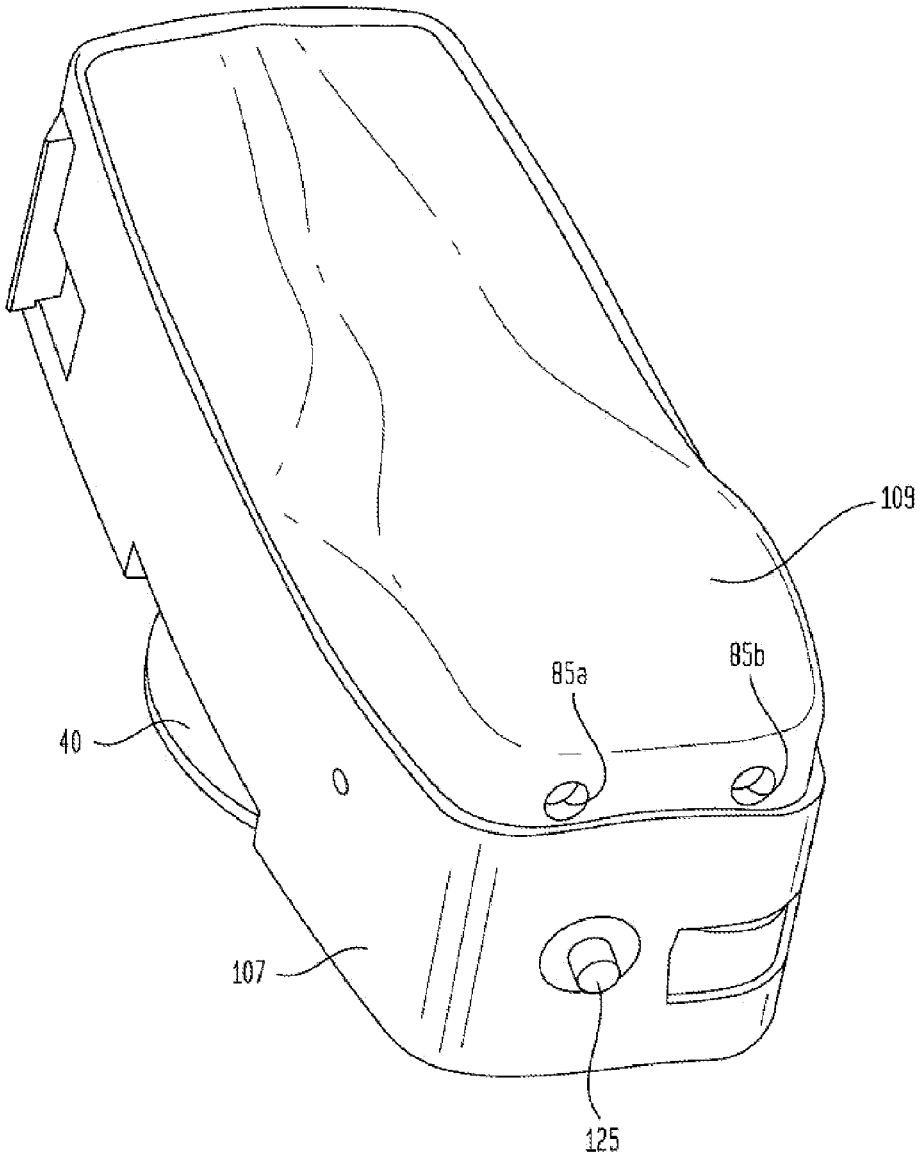

FIGS. 7, 8 and 9 show various views of hearing aid 10 according to another embodiment thereof. FIG. 7 shows a cross-sectional view of such an embodiment, where hearing aid includes upper housing 109 within which is disposed microphone 85*a*. Upper housing 109 is attached to main housing 107, and permits microphones 85*a* and 85*b* (see FIG. 9) to be physically separated from main housing 107, and to increase the degree of acoustic isolation between transducer 25 and microphones 85*a* and 85*b*. Sound attenuating or absorbing material 111 is disposed inside upper housing 109, and further increases the degree of acoustic isolation between transducer 25 and microphones 85*a* and 85*b*. Sound attenuating or absorbing material 111 may comprise any of the materials discussed above in connection with FIGS. 4 through 6. FIG. 8 shows a top left perspective view of hearing aid 10 of FIG. 7. FIG. 9 shows a top front perspective view of hearing aid 10 of FIG. 7, where two microphones 85*a* and 85*b* are shown mounted in upper housing 109. In one embodiment, either or both of microphone 85*a* and 85*b* are directional microphones.

In addition to the systems, devices, and components described above, it will now become clear to those skilled in the art that methods associated therewith are also disclosed, such as a first method of reducing feedback between a transducer and a microphone in a bone conduction magnetic hearing aid comprising providing a transducer encapsulation compartment around the transducer that is configured to attenuate or reduce the propagation of sound waves generated by the transducer to the microphone, and a second method of reducing feedback between a transducer and a microphone in a bone conduction magnetic hearing aid comprising providing a microphone encapsulation compartment or sound attenuating or absorbing material around the microphone that is configured to attenuate or reduce the propagation of sound waves generated by the transducer to the microphone.

Various aspects or elements of the different embodiments described herein may be combined to implement wholly passive noise reduction techniques and components, wholly active noise reduction techniques and components, or some combination of such passive and active noise reduction techniques and components.

Where applicable, various embodiments provided in the present disclosure may be implemented using hardware, software, or combinations of hardware and to software. Also, where applicable, the various hardware components and/or software components set forth herein and in the '125 patent application may be combined into composite components comprising software, hardware, and/or both without departing from the spirit of the present disclosure. Where applicable, the various hardware components and/or software components set forth herein and in the '125 patent application may be separated into sub-components comprising software, hardware, or both without departing from the scope of the present disclosure. In addition, where applicable, it is contemplated that software components may be implemented as hardware components and vice-versa.

Software, in accordance with the present disclosure, such as computer program code and/or data for digital signal processing in processor 80, may be stored on one or more computer readable mediums. It is also contemplated that software identified herein or in the '125 patent application may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing has outlined features of several embodiments so that those skilled in the art may better understand the detailed description set forth herein. Those skilled in the art will now understand that many different permutations, combinations and variations of hearing aid 10, and of various computing or portable electronic or communication devices disclosed in the '125 patent application fall within the scope of the various embodiments. Those skilled in the art should appreciate that they may readily use the present disclosure as a basis for designing or modifying other processes and structures for carrying out the same purposes and/or achieving the same advantages of the embodiments introduced herein and in the '125 patent application. Those skilled in the art should also realize that such equivalent constructions do not depart from the spirit and scope of the present disclosure, and that they may make various changes, substitutions and alterations herein without departing from the spirit and scope of the present disclosure.

For example, wireless transmitting and/or receiving means may be attached to or form a portion of hearing aid 10, and such wireless means may be implemented using Wi-Fi, Bluetooth, or cellular means. Hearing aid 10 may be configured to serve as a device that records and stores sound or acoustic signals generated by transducer 25 while hearing aid 10 is being worn by a patient. Such signals may be recorded and stored according to a predetermined schedule or continuously, and may be recorded and stored over brief periods of time (e.g., minutes) or over long periods of time (e.g., hours, days, weeks or months). Such stored signals may be retrieved and uploaded at a later point in time for subsequent analysis, and can, for example, be employed to determine optimal coupling, electronic, drive, sound reception or other parameters of hearing aid 10. Accelerometers or other devices may be included in hearing aid 10 so that posture, positions and changes in position of hearing aid 10 may be detected and stored. Moreover, the above-described embodiments should be considered as examples, rather than as limiting the scopes thereof.

After having read and understood the present specification, those skilled in the art will now understand and appreciate that the various embodiments described herein provide solutions to long-standing problems in the use of hearing aids, such eliminating or at least reducing the amount of feedback occurring between transducer 25 and one or more microphones 85.

We claim:

1. A bone conduction magnetic hearing aid, comprising:

an electromagnetic ("EM") transducer configured to generate sound waves, the EM transducer being disposed in a first housing;

at least one microphone disposed in, on or near the first housing, the at least one microphone being configured to detect external ambient sounds in a vicinity of the hearing aid, the EM transducer being configured to generate the sound waves in response to the external ambient sounds detected by the at least one microphone, and a transducer encapsulation second housing or compartment disposed inside the first the second housing or compartment being disposed around at least portions of the EM transducer, the second housing or compartment being configured to block, absorb or attenuate sound waves generated by the EM transducer that propagate in the direction of the at least one microphone, the second housing or compartment having portions disposed directly between the at least one microphone and the transducer;

wherein the second housing or compartment is configured to reduce or minimize undesired feedback between the EM transducer and the at least one microphone, the second transducer encapsulation housing or compartment comprises inner and outer transducer encapsulation compartments having a volume disposed therebetween, and the volume is filled or partially filled with at least one sound attenuating or absorbing material, liquid, gas or gel, or has been evacuated of gas or air.

2. The hearing aid of claim 1, wherein the second transducer encapsulation housing or compartment comprises or is formed of one or more of a poro-elastic material, a porous material, a foam, a polyurethane foam, polymer microparticles, an inorganic polymeric foam, a polyurethane foam, a smart foam, a cellular porous sound absorbing material, cellular melamine, a granular porous sound absorbing material, a fibrous porous sound absorbing material, a closed-cell metal foam, a metal foam, a gel, and an aerogel.

3. The hearing aid of claim 1, wherein the second transducer encapsulation housing or compartment comprises one of a flexural sound absorbing material and a resonant sound absorbing material configured to dampen or reflect sound waves incident thereon.

4. The hearing aid of claim 1, wherein the second transducer encapsulation housing or compartment is dimensioned, configured and formed of appropriate materials such that such the transducer encapsulation compartment is tuned to resonate at peak frequencies associated with noise generated by the transducer.

5. The hearing aid of claim 1, wherein the at least one microphone is surrounded by at least a third microphone encapsulation housing or compartment.

6. The hearing aid of claim 5, wherein the third microphone encapsulation housing or compartment further comprises at least one of a sound attenuating or absorbing material, a flexural sound absorbing material, and a resonant sound absorbing material.

7. The hearing aid of claim 5, wherein the third microphone encapsulation housing or compartment comprises inner and outer microphone encapsulation compartments having a volume disposed therebetween.

8. The hearing aid of claim 7, wherein the volume is filled or partially filled with at least one sound attenuating or absorbing material, liquid, gas or gel, or has been evacuated of gas or air.

9. The hearing aid of claim 5, wherein the third microphone encapsulation compartment is dimensioned, configured and formed of appropriate materials such that such the microphone encapsulation compartment is tuned to resonate at peak frequencies associated with noise generated by the transducer.

10. The hearing aid of claim 1, wherein the at least one microphone is potted in or surrounded by a sound attenuating or absorbing material.

11. The hearing aid of claim 1, wherein the at least one microphone is a directional microphone.

12. The hearing aid of claim 1, wherein one or more noise cancellation microphones are provided inside the hearing aid.

13. The hearing aid of claim 1, further comprising a sealing membrane disposed between a disk and the EM transducer, the disk being operably connected to a magnetic spacer disposed therebeneath.

14. A bone conduction magnetic hearing aid, comprising:

an electromagnetic ("EM") transducer configured to generate sound waves, the EM transducer being disposed in a first housing;

at least one microphone disposed in, on or near the first housing, at least one the microphone being configured to detect ambient sounds in a vicinity of the hearing aid, the EM transducer being configured to generate the sound waves in response to the external ambient sounds detected by the at least one microphone, and a microphone encapsulation second housing or compartment disposed around at least portions of the at least one microphone, the second housing or compartment being configured to block, absorb or attenuate sound waves generated by the EM transducer that propagate in the direction of the at least one microphone, the second housing or compartment having portions disposed directly between the transducer and the at least one microphone;

wherein the second housing or compartment is configured to reduce or minimize undesired feedback between the EM transducer and the at least one microphone, the microphone encapsulation second housing or compartment comprises inner and outer microphone encapsulation compartments having a volume disposed therebetween, and the volume is filled or partially filled with at least one sound attenuating or absorbing material, liquid, gas or gel, or has been evacuated of gas or air.

15. The hearing aid of claim 14, wherein the microphone encapsulation second housing or compartment comprises or is formed of one or more of a poro-elastic material, a porous material, a foam, a polyurethane foam, polymer microparticles, an inorganic polymeric foam, a polyurethane foam, a smart foam, a cellular porous sound absorbing material, cellular melamine, a granular porous sound absorbing material, a fibrous porous sound absorbing material, a closed-cell metal foam, a metal foam, a gel, and an aerogel.

16. The hearing aid of claim 14, wherein the microphone encapsulation second housing or compartment comprises one of a flexural sound absorbing material and a resonant sound absorbing material configured to dampen or reflect sound waves incident thereon.

17. The hearing aid of claim 14, wherein the microphone encapsulation second housing or compartment is dimensioned, configured and formed of appropriate materials such that such the microphone encapsulation compartment is tuned to resonate at peak frequencies associated with noise generated by the transducer.

18. The hearing aid of claim 14, wherein the at least one microphone is a directional microphone.

19. The hearing aid of claim 14, further comprising a sealing membrane disposed between a disk and the EM transducer, the disk being operably connected to a magnetic spacer disposed therebeneath.

20. A method of reducing feedback between an electromagnetic ("EM") transducer and at least one microphone in a bone conduction magnetic hearing aid, the EM transducer being configured to generate sound waves, the EM transducer being disposed in a first housing, the at least one microphone being disposed in, on or near the first housing, the at least one microphone being configured to detect external ambient sounds in a vicinity of the hearing aid, the EM transducer being configured to generate the sound waves in response to the external ambient sounds detected by the at least one microphone, a transducer encapsulation second housing or compartment being disposed inside the first housing, the second housing or compartment being disposed around at least portions of the EM transducer, the second housing or compartment being configured to block, absorb or attenuate sound waves generated by the EM transducer that propagate in the direction of the at least one microphone, the second housing or compartment having portions disposed directly between the at least one microphone and the transducer, wherein the second housing or compartment is configured to reduce or minimize undesired feedback between the EM transducer and the microphone, the second transducer encapsulation housing or compartment comprises inner and outer transducer encapsulation compartments having a volume disposed therebetween, and the volume is filled or partially filled with at least one sound attenuating or absorbing material, liquid, gas or gel, or has been evacuated of gas or air, the method comprising:

providing the transducer encapsulation second housing or compartment in the hearing aid.

21. A method of reducing feedback between an electromagnetic ("EM") transducer and at least one microphone in a bone conduction magnetic hearing aid, the electromagnetic ("EM") transducer being configured to generate sound waves, the EM transducer being disposed in a first housing, the at least one microphone being disposed in, on or near the first housing, the at least one microphone being configured to detect ambient sounds in a vicinity of the hearing aid, the EM transducer being configured to generate the sound waves in response to the external ambient sounds detected by the at least one microphone, and a microphone encapsulation second housing or compartment disposed around at least portions of the at least one microphone, the second housing or compartment being configured to block, absorb or attenuate sound waves generated by the EM transducer that propagate in the direction of the at least one microphone, the second housing or compartment having portions disposed directly between the transducer and the at least one microphone, wherein the second housing or compartment is configured to reduce or minimize undesired feedback between the EM transducer and the microphone, the microphone encapsulation second housing or compartment comprises inner and outer microphone encapsulation compartments having a volume disposed therebetween, and the volume is filled or partially filled with at least one sound attenuating or absorbing material, liquid, gas or gel, or has been evacuated of gas or air, the method comprising:

providing the microphone encapsulation second housing or compartment in the hearing aid.

* * * * *